United States Patent [19]

Beaudet

[11] Patent Number: 4,822,631

[45] Date of Patent: Apr. 18, 1989

[54] PROCESS ELECTROSTATIC IMAGING AND DEVELOPING

[75] Inventor: Leo A. Beaudet, Milford, Mass.

[73] Assignee: Dennison Manufacturing Company, Framingham, Mass.

[21] Appl. No.: 18,307

[22] Filed: Feb. 24, 1987

Related U.S. Application Data

[63] Continuation-in-part of Ser. No. 643,334, Aug. 22, 1984, abandoned.

[51] Int. Cl.[4] ..... B05D 1/06

[52] U.S. Cl. ..... 427/14.1; 430/99; 430/126

[58] Field of Search ..... 427/14.1; 430/31, 53, 430/54; 118/641

[56] References Cited

U.S. PATENT DOCUMENTS

| | | | |
|---|---|---|---|
| 3,374,769 | 3/1968 | Carlson | 118/641 |
| 3,669,706 | 6/1972 | Sanders | 118/641 X |
| 3,854,975 | 12/1974 | Brenneman | 430/98 |
| 3,893,761 | 7/1975 | Buchan | 118/641 X |
| 4,362,764 | 12/1982 | Matkan | 427/14.1 |

*Primary Examiner*—J. David Welsh

*Attorney, Agent, or Firm*—Thomas O. Hoover; Arthur B. Moore

[57] ABSTRACT

An imaging member employed in the high temperature transfer of toner onto paper. The imaging member operates at temperatures above the melting temperature of the toner by sealing the porous structure of the imaging member with a material having suitable dielectric, thermal and fluid release properties.

16 Claims, 1 Drawing Sheet

PROCESS ELECTROSTATIC IMAGING AND DEVELOPING

This is a Continuation in Part of Ser. No. 643,334 filed on Aug. 22, 1984, now abandoned.

BACKGROUND OF THE INVENTION

The invention relates to the high temperature transfer of toner between an electrostatic imaging member and a toner receptive surface such as paper. More particularly, the invention relates to the sealing of structures to achieve desired resistivity, dielectric and fluid toner release properties for electrostatic printing and copying devices.

As disclosed in U.S. Pat. No. 4,518,468 an aluminum member may be anodized by an electrolytic process to produce thick oxide coatings with substantial hardness and porosity. The pores of the oxide coating can be filed with a material having suitable dielectric and thermal properties necessary for the transfer of toner.

The anodization of a metal, such as aluminum, to form thick dielectric coatings takes place in an electrolytic bath containing an acid, such as sulfuric or oxalic, in which the metal oxide is slightly soluble. The production techniques, properties, and applications of thick aluminum oxide coatings are described in detail in "The Surface Treatment and Finishing of Aluminum and its Alloys" by S. Wernick and R. Pinner, 4th Edition, 1972, published by Robert Draper Ltd., Peddington, England (chapter IX, page 563). Such coatings are extremely hard and mechanically superior to uncoated aluminum. The coatings contain pores in the form of fine tubes, with a porosity on the order of $10^{10}$ to $10^{12}$ pores per square inch. Typical porosities range from 10 to 30 percent by volume.

For improved mechanical properties as well as to prevent staining, it is customary practice to seal the pores. One standard sealing technique involves partially hydrating the oxide through immersion in boiling water, usually containing certain nickel salts, which forms an expanded beohmite structure in the mouths of the pores. Oxide sealed in this manner will not support an electrostatic charge due to the ionic conductivity of moisture trapped in the pores.

U.S. Pat. No. 3,615,405 discloses a fabrication of an electrophotographic oxide surface by impregnating a porous oxide aluminum surface with an "imaging material." Direct contact is required between the imaging material and the conductive substrate over which the porous oxide layer is formed. This is to provide discharge in radiation struck areas so as to form the electrostatic image to be copied. The present invention transfers the electrostatic image directly without radiation induced discharge. In the '405 patent there is no dehydration of the oxide pores prior to impregnation with an imaging material. This results in a likelihood of trapped moisture, which is deleterious to the dielectric properties of the impregnated anodic layer. The disclosed resistivity of the layer is too low to be employed in accordance with the present invention.

A drum coated with an insulating film capable of supporting an electrostatic charge is disclosed in U.S. Pat. No. 3,907,560. However, at the thicknesses disclosed the oxide layer will support a limited maximum voltage. Also the surface transmits any localized strains through the thin film causing deformation of the aluminum substrate.

In U.S. Pat. No. 4,518,468 carnauba and montan waxes are used as impregnates. They are applied as liquids to an aluminum member at elevated temperatures between 120° C. and 180° C. to assure good penetration and sealing of the pores. While producing excellent results at low temperatures, these waxes cannot be used as impregnates where the dielectric layer must be maintained at temperatures above the melting temperature of the toner because toner flow temperatures typically exceeded the melting temperatures of these waxes. Thus, toner flow temperatures substantially impair the toner release characteristics of the wax impregnates.

In the '468 patent, as the toner particles approach the nip, pressure is applied in order to simultaneously transfer and fuse the toner to paper. Pressures of between 250 and 300 lbs/linear inch between the dielectric member and the paper are typically necessary to achieve efficient fusing. To maintain good transfer efficiency it is necessary to skew the rollers. Skewing of the rollers necessitates skewing of the printhead to maintain proper alignment of the print. This results in a reduction in print quality as the dot size becomes variable depending on how much the cartridge is skewed.

There are other aspects associated with high pressure/low temperature transfer of toner. The papers that are typically toned undergo shrinkage at high pressures. This shrinking of toned papers is highly unsuitable for printing applications where the paper must match predetermined paper size specifications. High pressures also cause "blooming" or expansion of the printed characters. This results from the crushing of the toner particles into the paper. Associated with the reduction in print quality caused by "blooming" is the increase in gloss caused by the high pressure fusion of toner to the paper. It is also desirable to minimize gloss.

It is apparent that a substantial improvement in print quality can be achieved if high transfer efficiencies can be maintained using low pressure transfer of toner. The waxes, resins, stearates or epoxies that might normally be used to impregnate a porous member suffer a substantial reduction in dielectric capacity and/or toner release properties at temperatures where the toner can be melted without pressure.

Accordingly, it is an object of the invention to provide the desired dielectric properties in porous anodized members, while permitting lower pressure transfer of the toner. A related object is to melt the toner without pressure prior to transfer, that is, to permit the dielectric member to operate at temperatures above the melting temperature of the toner without substantial degradation of dielectric strength or loss in release properties.

SUMMARY OF THE INVENTION

In accomplishing the foregoing and related objects the invention provides a method of producing a dielectic member utilized in electrostatic imaging where the toner may be melted and transferred at a significantly reduced pressure between the dielectric member and a toner receptive surface such as paper. Melting the toner without pressure prior to transfer can be accomplised by impregnating the pores of an anodized member with a material having suitable dielectric properties at temperatures above the melting temperatures of the toner. The toner on the surface of the dielectric member may thereby be melted by heating without substantial loss of image quality prior to transfer of the fluid toner.

The dielectric member is manufactured by anodizing a suitably shaped metal such as an aluminum cylinder by immersion in a bath and electrolytically oxidizing the surface to form a porous oxide layer. This layer has a depth of between 0.25–4.0 mils, preferably 1–2 mils, and a porosity between about 5 and 30 percent by volume. The anodized member is than dehydrated by heating it in air or preferably in a vacuum. A temperature of between 80° C. and 300° C., preferably about 200° C. for several hours, may be used.

After cooling to about 50° C., the dehydrated anodized member is impregnated with a material that retains its dielectric and good toner release properties above the melting temperature of the toner. Toners generally in use having melting temperatures at or below 120° C. After impregnation of the member, any excess impregnated is wiped from the member's surface, and the impregnate is cured. Subsequent to curing of the impregnate, the member is polished. The polished surface preferably has a better than 10 microinch rms finish. In the preferred embodiment of the invention this results in a thick, hard surface with a resistivity in excess of $10^{12}$ Ohm-cm.

Materials using silicon such as silicone rubbers or resins which may be applied to the pores as a low viscosity paste have been found to be highly suitable for the present invention. These silicones are known to retain their dielectric properties and good toner release characteristics up to 200° C.

In accordance with the preferred embodiment of the invention, the aluminum member with its dielectric layer is in cylindrical form for use in electrostatic imaging. A heating element is inserted in the aluminum core of the cylinder so that the dielectric surface can be heated to above the melting temperature of the toner, and as high as 200° C. The dielectric surface layer is than charged by an ion generating printhead. A toner is than applied to the surface of the dielectric, melted either on contact or prior to transfer to paper, and transferred at pressures at or below about 50 lbs/linear inch to paper or some other toner receptive surface. The heated, polished surface yields an essentially complete pressure transfer of toner.

DETAILED DESCRIPTION

Figure 1:
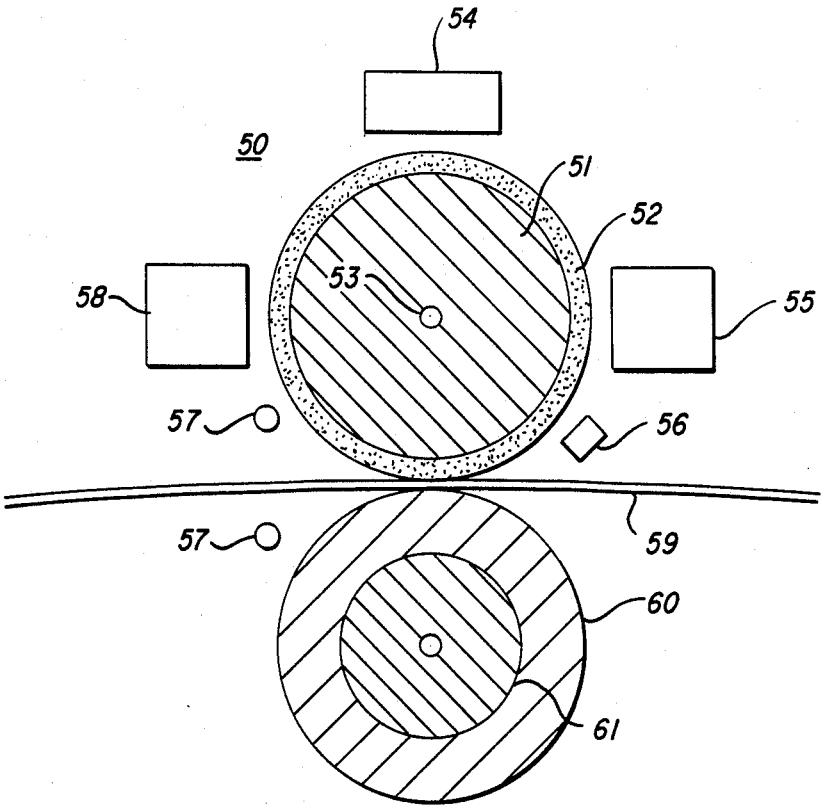
FIG. 1 is a schematic view of an electrostatic printer incorporating an image cylinder fabricated in accordance with the invention.

The invention provides for fabricating and treating anodized members by a series of processing steps which result in members that are particularly suited to electrostatic imaging. The invention further provides a method of using the anodized member where the toner is first melted without pressure on the surface and then transferred.

The treated member, preferably an imaging cylinder having a dielectric surface layer and a conducting core, receives an electrostatic latent image, and carries the latent image with minimal charge decay to a position where the image is toned and then transferred to a toner receptive surface under minimal pressure. The properties of particular concern are the hardness and abrasion resistance of the surface; the charge acceptance and dielectric capacitance of the dielectric layer; the resistivity of the dielectric layer; and the thermal and release characteristics of the surface with respect to toner.

In the preferred embodiment of the invention, a cylinder of aluminum is machined to a desired length and outside diameter. The surface is smoothed to prepare for anodization where an oxide is deposited on the surface of the aluminum cylinder to depth of approximately 1 to 2 mils. Following anodization, the member's surface is thoroughly rinsed in deionized water in order to remove all of the anodizing bath, salts, acids and other residual substances from the pores.

After anodization, the porous surface layer is dehydrated. For best results, the dehydration is accomplished immmediately after anodization in order to avoid a reaction with ambient moisture which partially seals the porous oxide so that subsequent impregnation is incomplete and dielectric properties degraded. Removal of absorbed water from the oxide layer can be accomplished by heating, placing the article under a vacuum, or by storage in a desiccator. The best results are obtained by heating in a vacuum. Other methods result in a slightly lower level of charge acceptance. It is preferable that any thermal treatment of the oxide prior to impregnation be carried out at a temperature in the range from about 80° C. to about 300° C., with the preferred temperature being about 200° C. After removal of absorbed water, the oxide coating may be sealed with a variety of silicone materials including silicone rubbers and resins. A low viscosity silicon paste is impregnated into the pores after the cylinder has cooled to about 50° C. The silicone paste reacts with moisture in the air to form a very hard abrasion resistant surface. Such silicone pastes give off acetic acid or alcohol while being cured. Formulations manufactured by Dow Corning Inc., under the trade names Dow Corning 3140 and Dow Corning 1-2577 are satisfactory for this application. The 3140 is a room temperature vulcanized silicone rubber particularly suited to this purpose. The 1-2577 is a silicone resin which also has suitable thermal and dielectric properties. Literature from Dow Corning indicates that these silicone materials have a useful temperature range up to 200° C. and a dielectric constant between 2.63 and 2.71.

FIG. 1 shows schematically the incorporation of a dielectric cylinder of the preferred embodiment of the invention in an electrographic printing system. The printer 50 is formed by two metallic rollers 51 and 61. The upper roller, fabricated by the method described above, includes an dielectric surface layer 52 on a conducting cylinder 51, while the lower roller has a layer of thermoplastic material 60 over a metallic core 61. A latent electrostatic image in the pattern of an imprint is generated on the dielectric layer 52 by charging head 52. The latent image is then toned, for example by colored particles at station 55, following with the toned image is melted and transferred to a receptor sheet 59, to form the desired print. The toner may be heated by any number of methods including, for example, the insertion of a heating element into the hollow core 53, which heats the cylinder 51 and layer 52, so that the toner melts upon contact with the dielectric layer. Alternatively, the toner may be melted by a heating lamp 56 stationed between the toner station 55 and the point of transfer to the receptor sheet 59. The electrostatic printer desirably includes scraper blades 57 for removing any residual toner and a unit 58 for erasing any latent residual electrostatic image that remains on the dielectric layer 52 before reimaging takes place at the charging head 54.

In the preferred embodiment of the invention a heating element is inserted in the core of the dielectric cylinder. This heating element is used to maintain the temperature of the dielectric surface above the melting temperature of the toner, preferably around 200° C. The silicone rubber impregnate is able to maintain its charged image while the toner is delivered to the image on the cylinder. The toner melts upon contact with the heated cylinder and transfers at substantially reduced pressures to the substrate 59.

We claim:

1. An imaging method comprising the steps, in sequence, of:

(a) creating a latent electrostatic image on the surface of an imaging member, said imaging member having a hard porous oxide surface layer the pores of which are impregnated with a sealant having a melting temperature above the melting temperature of a toner, said sealant further having good dielectric properties at elevated temperatures below its melting temperature;

(b) delivering a quantity of said toner to the imaging member's surface to create a visible toner image corresponding to said latent electrostatic image;

(c) heating said toner to melt or soften the visible toner image; and (d) transferring said toner image to a receptor.

2. The method of claim 1 wherein the receptor comprises a sheet and the transferring step comprises passing the receptor sheet through a nip between the imaging member and a further member at a pressure under 25 lbs./linear inch.

3. The method of claim 2 wherein the imaging member and further member comprises cylinders.

4. The method of claim 1 wherein the heating step melts the toner.

5. The method of claim 1 wherein the sealant has a melting point above 120 degrees C.

6. The method of claim 5 wherein the sealant has a melting temperature above 200 degrees C.

7. The method of claim 1 wherein the imaging member comprises an aluminum member with a hardcoat anodized surface layer.

8. The method of claim 1 wherein the sealant comprises a material selected from the group consisting of silicone rubbers and resins.

9. The method of claim 1 wherein the receptor comprises plain paper.

10. An imaging method comprising the steps, in sequence, of:

(a) creating a latent electrostatic image on the surface of an imaging member, said imaging member having a hardcoat anodized porous oxide surface layer the pores of which are impregnated with a sealant having a melting temperature above the melting temperature of a toner, said sealant being selected from the group consisting of silicone rubbers and resins, said sealant having good dielectric properties at elevated temperatures below its melting temperature;

(b) delivering a quantity of said toner to the imaging member's surface to create a visible toner image corresponding to said latent electrostatic image;

(c) heating said toner to melt or soften the visible toner image; and (d) transferring said toner image to a receptor.

11. The method of claim 10 wherein the receptor comprises a sheet and the transferring step comprises passing the receptor sheet through a nip between the imaging member and a further member at a pressure under 25 lbs./linear inch.

12. The method of claim 12 wherein the imaging member and further member comprises cylinders.

13. The method of claim 10 wherein the heating step melts the toner.

14. The method of claim 1 wherein the sealant has a melting point above 120 degrees C.

15. The method of claim 14 wherein the sealant has a melting temperature above 200 degrees C.

16. The method of claim 10 wherein the receptor comprises plain paper.

* * * * *